US012415696B2

(12) United States Patent
Rodriguez et al.

(10) Patent No.: US 12,415,696 B2
(45) Date of Patent: Sep. 16, 2025

(54) ADHESIVE PAPERBAND COMPOSITE FOR TURN UP PROCEDURE

(71) Applicant: Papeltec Overseas, Inc., Atlantic Beach, FL (US)

(72) Inventors: Peter A. Rodriguez, Jacksonville, FL (US); Jason Rodriguez, Jacksonville, FL (US); Victor Rodriguez, Jacksonville, FL (US); Craig Austin, Jacksonville, FL (US)

(73) Assignee: Papeltec Overseas, Inc., Atlantic Beach, FL (US)

( * ) Notice: Subject to any disclaimer, the term of this patent is extended or adjusted under 35 U.S.C. 154(b) by 0 days.

(21) Appl. No.: 18/958,436

(22) Filed: Nov. 25, 2024

(65) Prior Publication Data

US 2025/0091827 A1 Mar. 20, 2025

Related U.S. Application Data

(60) Continuation of application No. 18/634,041, filed on Apr. 12, 2024, now Pat. No. 12,168,583, which is a (Continued)

(51) Int. Cl.
*B65H 20/02* (2006.01)
*B65H 18/14* (2006.01)
(Continued)

(52) U.S. Cl.
CPC ..... *B65H 18/145* (2013.01); *B65H 20/02* (2013.01); *D21H 19/14* (2013.01); *D21H 19/84* (2013.01);
(Continued)

(58) Field of Classification Search
CPC ..... B65H 18/145; B65H 20/02; D21H 19/14; D21H 19/84
See application file for complete search history.

(56) References Cited

U.S. PATENT DOCUMENTS 5,046,675 A 9/1991 Rodriguez
5,299,407 A 4/1994 Schuttler et al.
(Continued)

FOREIGN PATENT DOCUMENTS

EP 1026110 A2 1/2007
JP 2783976 B2 8/1998

OTHER PUBLICATIONS

International Search Report and Written Opinion issued in correlated international patent application PCT/US2022/048483 on Mar. 7, 2023.

*Primary Examiner* — Sang K Kim
(74) *Attorney, Agent, or Firm* — Tracnik Law; Joseph P. Kincart

(57) ABSTRACT

Paperband composites for transferring a paper web from a full web spool to an empty web spool. In some embodiments, the paperband composite is applied in several layers to an empty web spool, each layer suitable for fixedly attaching a paper web to the empty spool. Multiple layers of paperband composite allow for use during multiple turn-up procedures with one layer of paperband composite used per turn-up procedure. In some examples, the paperband composite may be applied to a paper spool tangentially along the spool face and perpendicular to the axis of rotation of the spool. In other examples, the paperband composite may be spirally wrapped around the paper spool.

20 Claims, 11 Drawing Sheets

Related U.S. Application Data division of application No. 18/384,789, filed on Oct. 27, 2023, now Pat. No. 12,030,734, which is a continuation of application No. 17/977,949, filed on Oct. 31, 2022, now Pat. No. 11,858,767.

(60) Provisional application No. 63/274,083, filed on Nov. 1, 2021.

(51) Int. Cl.
*D21H 19/14* (2006.01)
*D21H 19/84* (2006.01)

(52) U.S. Cl.
CPC ..... *B65H 2301/414323* (2013.01); *B65H 2301/51514* (2013.01); *B65H 2401/23* (2013.01)

(56) References Cited

U.S. PATENT DOCUMENTS

| | | | | |
|---|---|---|---|---|
| 5,417,383 | A | 5/1995 | Rodriguez et al. | |
| 5,472,154 | A | 12/1995 | Qiu et al. | |
| 5,620,544 | A | 4/1997 | Cram et al. | |
| 6,305,634 | B1 | 10/2001 | Rodriguez | |
| 6,405,969 | B1 | 6/2002 | Ogren et al. | |
| 6,416,012 | B1 | 7/2002 | Wilmoth et al. | |
| 6,575,395 | B2 | 6/2003 | Rodriguez | |
| 6,578,788 | B2 | 6/2003 | Rodriguez et al. | |
| 7,290,732 | B2 | 11/2007 | Wilmoth et al. | |
| 7,562,841 | B2 * | 7/2009 | Holden | B65H 75/182 493/299 |
| 7,875,152 | B2 | 1/2011 | Rodriguez | |
| 8,124,209 | B2 | 2/2012 | Rodriguez | |
| 9,102,491 | B2 | 8/2015 | Rodriguez | |
| 11,124,377 | B2 | 9/2021 | Rodriguez et al. | |
| 11,459,201 | B2 | 10/2022 | Rodriguez et al. | |
| 11,667,486 | B2 | 6/2023 | Rodriguez et al. | |
| 11,708,466 | B1 | 7/2023 | O'neal | |
| 11,858,767 | B2 * | 1/2024 | Rodriguez | B65H 19/283 |
| 11,897,714 | B2 | 2/2024 | Rodriguez et al. | |
| 12,030,734 | B2 * | 7/2024 | Rodriguez | D21H 19/84 |
| 12,168,583 | B2 * | 12/2024 | Rodriguez | B65H 18/145 |
| 2003/0052215 | A1 | 3/2003 | Rodriguez | |
| 2005/0098679 | A1 | 5/2005 | Camp | |
| 2005/0155714 | A1 | 7/2005 | Adams | |
| 2007/0059080 | A1 | 3/2007 | Silverbrook et al. | |
| 2009/0321007 | A1 | 12/2009 | Sekar | |
| 2013/0214077 | A1 | 8/2013 | Jensen | |
| 2014/0021285 | A1 | 1/2014 | Rodriguez | |
| 2017/0341894 | A1 | 11/2017 | Muller | |
| 2018/0312368 | A1 | 11/2018 | Harris et al. | |
| 2020/0101774 | A1 | 4/2020 | Fujiwara et al. | |
| 2023/0136940 | A1 | 5/2023 | Rodriguez et al. | |
| 2024/0051778 | A1 | 2/2024 | Rodriguez et al. | |

* cited by examiner

WIND A PAPERBAND COMPOSITE ONTO A FIRST SPOOL FACE OF THE EMPTY WEB SPOOL
802

FIXEDLY ATTACH THE PAPERBAND COMPOSITE TO THE FIRST SPOOL FACE SPOOL FACE WITH THE SPOOL FACE ADHESIVE
804

ROTATE THE EMPTY WEB SPOOL AND PAPERBAND COMPOSITE AT A ROTATIONAL SPEED APPROXIMATE TO A ROTATIONAL SPEED OF A SURFACE OF A PAPERWEB
806

CONTACT THE PAPERWEB WITH A PAPERWEB ADHESIVE IN THE PAPERBAND COMPOSITE
808

ADHESIVELY BIND A FIRST PORTION OF THE PAPERWEB TO THE EMPTY WEB SPOOL WITH THE FIRST QUANTITY OF THE PAPERWEB ADHESIVE
180

PERFORM A TURN-UP PROCESS CAUSING A FIRST VOLUME OF PAPER WEB TO SPOOL ON THE EMPTY WEB SPOOL
812

SPOOL THE FIRST VOLUME OF PAPER WEB ONTO THE EMPTY WEB SPOOL TO FORM A SECOND FULL WEB SPOOL
814

FIG. 8A

ADHESIVE PAPERBAND COMPOSITE FOR TURN UP PROCEDURE

CROSS REFERENCE TO RELATED APPLICATIONS

The present application claims priority to and is a continuation of U.S. Nonprovisional patent application Ser. No. 18/634,041, filed Apr. 12, 2024, and entitled ADHESIVE PAPERBAND COMPOSITE FOR TURN UP PROCEDURE, which is a divisional of U.S. Nonprovisional application Ser. No. 18/384,789, filed Oct. 27, 2023, and entitled ADHESIVE PAPERBAND COMPOSITE FOR TURN UP PROCEDURE, which is a continuation of U.S. Nonprovisional application Ser. No. 17/977,949, filed Oct. 31, 2022, and entitled METHODS AND APPARATUS FOR A TURN-UP PROCEDURE USING AN ADHESIVE PAPERBAND COMPOSITE, which claims the benefit of Provisional Patent Application Ser. No. 63/274,083 filed Nov. 1, 2021, entitled TEAR-OFF TURN-UP ADHESIVE; the entire contents of each of which are hereby incorporated by reference. The present application makes priority and benefit claims as outlined in the application data sheet; the present application also incorporates by reference in their entirety any matters included in the application data sheet as filed herewith.

INCORPORATION BY REFERENCE TO RELATED APPLICATIONS

The present application references Nonprovisional patent application Ser. No. 17/407,664, filed Aug. 20, 2021; and entitled HIGH SPEED PAPER WEB TURN-UP SYSTEM WITH A PREPARED LENGTH PAPERBAND COIL, the contents of which are hereby incorporated by reference.

FIELD OF THE INVENTION

This invention relates generally in a first sense to the field of devices, apparatuses, and methods of effecting the high-speed severing and transfer of a rapidly advancing paper web from a rotating full web spool onto an empty web spool, and more particularly where such an operation is performed utilizing a paperband, which may include a double-sided adhesive paperband. More particularly, the invention relates to a paperband composite and method for applying the composite to a paper web spool. The invention relates to the use of the paperband composite in a paper web severing/transfer method, wherein the paperband severs, transfers, and secures the paper web from a rotating full web spool onto a rotating empty web spool.

BACKGROUND OF THE INVENTION

Modern paper manufacturing is typically performed by producing continuous lengths of paper having widths of over 400 inches in some cases, referred to as paper webs, which are wound onto web spools for subsequent converting, storage, transfer, or the like. The winding or spooling operation for the paper web, such as in the case of tissue grades, occurs at high speeds, in some cases exceeding 6000 feet per minute, and in order to maximize production by minimizing downtime and waste it is desirable to sever and simultaneously transfer the moving paper web from a full web spool onto an empty web spool without stopping, adjusting draws (i.e. the speed differential between the incoming and outgoing web rotating support members that are not driven by a common source) or slowing the movement of the web.

Methods and apparatuses for accomplishing this severing and transfer utilizing what is known as a transfer or turn-up tape have long been known. A noted aspect of turn-up tape is that each application is only useful through one turn-up, followed by its removal from the empty web spool once the accumulated paper is unwound in subsequent operations. Light grades of paper are often wound on laminated cores, removal of paperbands can remove the outer layers of paper from the laminated core.

The removal of outer layers causes irreparable damage to the surface of the laminated core such that attempts to adhere another application of turn-up tape is limited to areas of the laminated core surface that have not been damaged. In this way, the useful life of the laminated core is limited, and frequent replacement of laminated cores is required.

The cost of a new laminated core is significant, and some paper mills award bonuses or other recognition to paper machine operators who can extend the useful life of a laminated core by careful and judicious application and removal of turn-up tape.

SUMMARY OF THE INVENTION

Accordingly, the present invention provides apparatus, devices, and methods to create and utilize paperband composites that may be used for multiple spooling cycles. The paperband composite includes a paperband that accomplishes multiple turn-up processing while also reducing damage to a laminate core. In some embodiments, the present invention provides a paperband composite that includes a substrate with regional coatings of adhesives, release layers, and perforations at predetermined locations conducive to application to an empty web spool to accomplish turn-up processes for multiple spooling cycles.

In some embodiments, a paperband composite for transferring a paper web from a full web spool to an empty web spool is provided. Methods of practice may include winding a paperband composite onto a first spool face of the empty web spool, the paperband composite having a spool face adhesive and a paperweb adhesive and transferring a paper web from a full web spool to an empty web spool. The paperband composite may be fixedly attached to the first spool face spool face with the spool face adhesive. The paper web may be transferred from a full web spool to an empty web spool, and the empty web spool and paperband composite may be rotated at a rotational speed approximate to a rotational speed of a surface of a paperweb being wound on a first full web spool.

The paperweb may be contacted with a first quantity of a first paperweb adhesive included in the paperband composite and transfer the paper web from a full web spool to the empty web spool.

The methods of the present invention may additionally include adhesively binding a first portion of the paperweb to the empty web spool with the first quantity of the paperweb adhesive. Performance of a turn-up process causes a first volume of paper web to spool on the empty web spool.

Implementations may include unspooling a first volume of paperweb from the second full web spool to convert the second full web spool back into the empty web spool and removing a first quantity of paperweb adhesive and corresponding paperband composite from the empty web spool to expose a second quantity of paperweb adhesive. A second portion of the paperweb may then be adhesively bound to the second quantity of paperweb adhesive while the empty web spool is rotating, and a second turn-up process may be performed causing a second volume of paper web to spool on the empty web spool.

In some embodiments, the paperband composite further may include a plurality of perforations, and the step of removing the first quantity of paperweb adhesive and corresponding paperband composite from the empty web spool may include tearing the paperband composite along the plurality of perforations.

In some embodiments, the step of removing the first quantity of paperweb adhesive and corresponding paperband composite follows the unspooling of the first volume of paperweb from the second full web spool and is before performance of a second turn-up process.

In various embodiments, a paperband composite may have a width essentially equal to or less than a width of a spool face of the empty web spool and the paperband composite may be wrapped approximately perpendicular to an axis of the empty web spool.

In other embodiments, a paperband composite may be wrapped in a spiral fashion around the empty web spool. A paperband composite may be formed with an angular cut out at an initial edge to aid in alignment of the angular cut out with an axis of the empty spool.

In apparatus embodiments, a paperband composite may include a substrate formable for wrapping around an empty web spool with a length of the substrate sufficient to wrap the substrate around an empty web spool multiple times. A paperband composite may also include a first zone coated region having a spool face adhesive on a first side of the substrate and include a second zone coated region having a release coating of the first side of the substrate, the second zone coated region may occupy a majority of a first side of a substrate that is not included in the first zone.

In some embodiments, a paperband composite may in addition include a paper web adhesive coating on a second side of the substrate, the paper web adhesive having an adhesive having sufficient binding strength to burst a paper web being spooled on a full web spool. Multiple perforations may be spaced in a paperband composite such that when the paperband composite is wrapped upon the paper spool there is a perforation at each layer of the wrapping. In some implementations a spacing between multiple perforations is not equal to a circumference of the empty paper web spool which results in staggered positioning of the perforations with each wrapping. An angular cut-out at an end of the paperband composite may be placed upon the empty web spool to start a winding of the paperband composite onto the empty web spool and align angular cut-out in the paperband composite with a position to start a winding of the paperband composite onto the empty web spool in a spiral pattern.

Generally, a spool face adhesive may have a tensile strength sufficient to hold a paperband composite in place on an empty web spool but not be sufficient to cause damage to a spool face when the paperband composite is removed.

Similarly, a paper web adhesive coating may form a bond having a tensile strength sufficient to adhere to a paper web during a turn-up operation and adhere the wrapped paperband composite to the empty web spool when the paperband composite is torn along a perforation in the paperband composite.

In one general aspect, the present invention may include cutting a substrate layer and/or a paperband to a width target calculated as a fraction of a width of a spool face reduced by a margin distance for each end, and a target length based upon a number of desired wraps of the substrate layer around the spool face multiplied by a circumference of the spool face. May also include applying a length of spool face adhesive to a first side of the substrate layer based on the circumference of the paper spool. May furthermore include applying a release formulation to at least a portion of an uncoated part of the first side of the substrate layer. May in addition include applying a web grabbing adhesive formulation to a second side of the substrate layer. Other embodiments of this aspect include corresponding computer systems, apparatus, and computer programs recorded on one or more computer storage devices, each configured to perform the actions of the methods.

Implementations may include one or more of the following actions: cutting the substrate layer at an edge at an angle to an adjacent side edge, where the angle creates a new edge of the paperband composite that may be applied to the paper spool; preparing a turn-up paperband composite further may include: cutting a perforation along a body of the substrate layer, where a direction of the perforation is aligned to the angle of a new edge of the paperband composite.

In some examples, the paperband composite may be applied in a manner generally aligned with the axis of the paper spool. In other examples, the paperband composite may be wrapped in a spiral fashion around the paper spool.

BRIEF DESCRIPTION OF THE DRAWINGS

FIGS. 8A-8B illustrate method steps that may be executed in some embodiments of the present invention.

DESCRIPTION OF THE INVENTION

Figure 1:
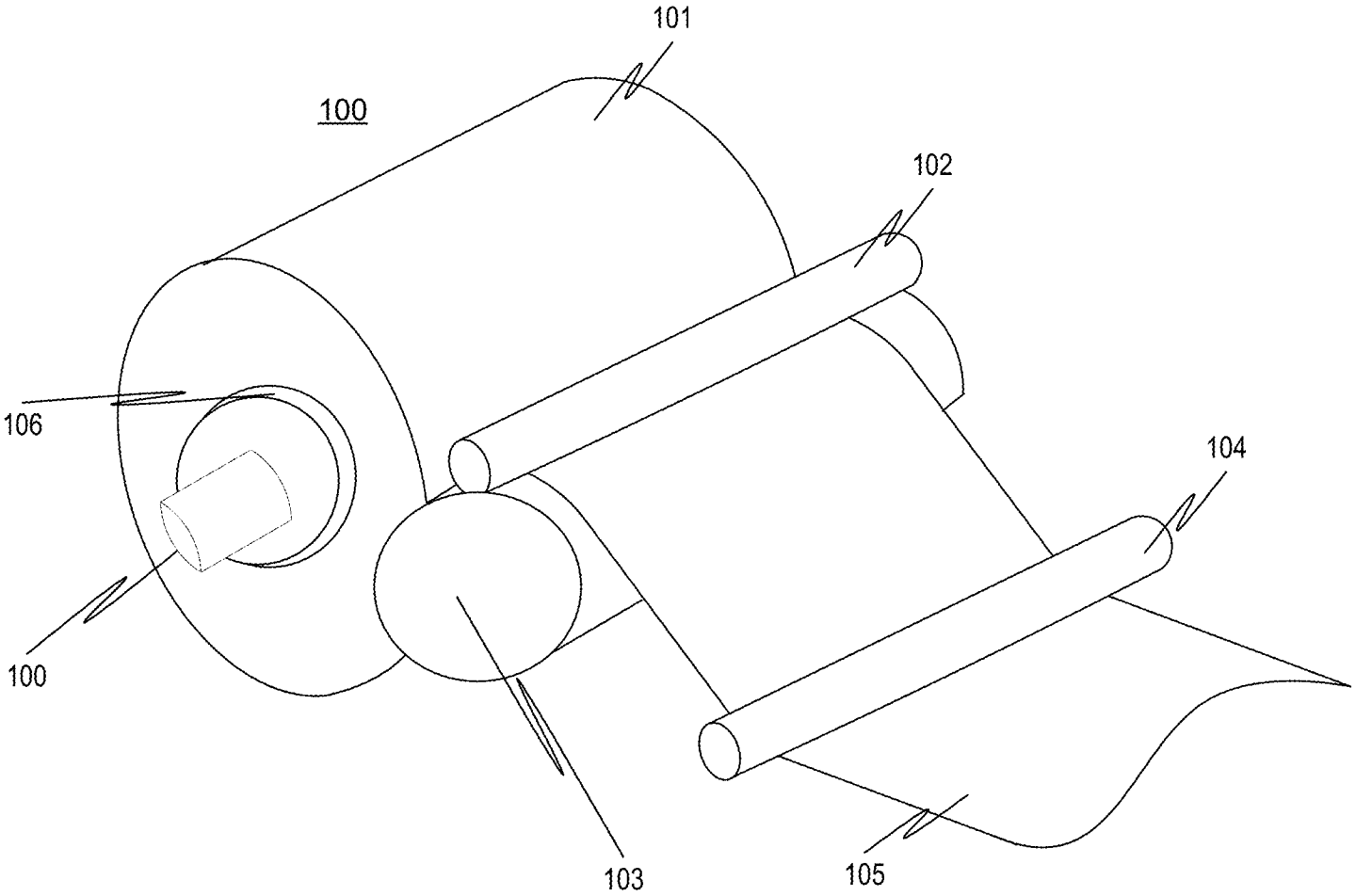
FIG. 1 illustrates a perspective view of a Parent Roll, an Empty Web Spool, and Paper Web with a Turn-up Dispenser.

The present invention provides methods and apparatus to perform a paper machine turn up process using a paperband composite that adhesively attaches a paper web to an empty web spool. In some embodiments of the present invention, a paperband composite is applied in several layers to an empty web spool, each layer of paperband composite including an outwardly facing adhesive suitable for fixedly attaching a paper web to the empty web spool. The multiple layers of paperband composite allow for multiple uses for each application to paper processing spools. In some examples, the paperband composite may be applied to an empty web spool tangentially along a spool face and perpendicular to an axis of rotation of the web spool. In other examples, the paperband composite may be spirally wrapped around the empty web spool.

With reference to the drawings, which are provided for descriptive and illustrative purposes which are not meant to be limiting as the scope of the invention, the invention in various embodiments in a broad and general sense includes apparatus and methods for conducting paper web turn-up operation. The processes facilitate a turn up operation wherein a continuous paper web being rolled onto a first web spool is severed and transferred to an empty second web spool, such as, for example when the first web spool is fully wound. In the operation, a transfer may occur without requiring a flow of the paper web to be significantly altered or stopped.

Paperband composites may be applied in multiple layers, each layer providing an outward exposed adhesive for fixedly attaching a paper web to the spool. In some embodiments each layer may also include an inward exposed adhesive for attachment of the paperband composite to an empty spool. Adhesive may provide a binding force sufficient to secure the paper web to the empty spool and removable in a manner that reduces damage to a spool face. In a general sense, the paperband composite may be applied to the paper spool in multiple various embodiments, which are described herein. The applied paperband composite may be wrapped around the paper spool, substantially covering the entire surface of the paper spool with the paperband composite.

Accordingly, there may be a significant surface area of the paper spool that the paperband composite may be applied to. Due to this significant surface area, the adhesive strength of these approaches may be engineered to be less strong since the overall strength of attachment is a function of both the adhesive strength and the surface area it is applied to. A larger area of adhesion with a low adhesion strength per area unit minimizes (or eliminates) damage to the paper spool, since removal of the generally weaker adhesive when the paperband composite has been fully used induces less damage. Furthermore, since a surface of the Empty Web Spool is significantly covered by the paperband composite, the paperband composite affords a level of protection to the Empty Web Spool and also reduces irregularities in a surface of paper web ultimately wound around the Empty Web Spool, transforming the Empty Web Spool into a Full Web Spool.

Glossary

Composite: as used herein a Composite means an item made up of distinct parts or elements.

Empty Web Spool: as used herein an Empty Web Spool (sometimes referred to as an Empty Reel, a New Spool, a Reel Spool, Web Spool, or an Empty Spool), means a spool with a spool face essentially devoid of paperweb. The spool face may have paperband composite wound around it and fixedly attached to it. The spool face of an Empty Web Spool is commonly used to adhere a transfer tape upon and receive paperweb transferred from being accumulated onto a full web spool.

Nip: as used here Nip refers to the area where a paperweb or sheet is pressed between two rolls/spools.

Paperband: as used herein a Paperband (sometimes referred to as a turn-up tape, transfer tape or Paper Band), refers to a substrate adapted for extending across a longitudinal cylindrical surface of one or both of an empty web spool and a paper bearing web spool. A Paperband may include multiple layers.

Paperband Composite: as used herein means a Paperband with a first side and a second side, each of the first side having at least one layer of adhesive. A Paperband Composite may include multiple distinct elements and/or parts.

Paper Web: as used herein refers to a newly formed continuum of paper that is processed and rolled on a paper machine.

Full Web Roll: as used herein a Full Web Roll (which may sometimes be referred to as an Old Spool, a Parent Web Spool, or a Full Spool), refers to a web spool that is substantially nearing its capacity for holding paper web.

Reel Drum: as used herein a Reel Drum refers to a spool used to drive movement of a paper web; in some embodiments a Reel Drum may impart rotational movement to a Parent Roll receiving a paper web in a reeling action.

Transfer Tape: as used herein a Transfer Tape (sometimes referred to as a turn-up tape, or Paper Band), refers to a substrate adapted for extending across a longitudinal cylindrical surface of one or both of an empty web spool and a paper bearing web spool. The Transfer Tape may include multiple layers.

Transfer Tape Track: as used herein means an apparatus for containing a Transfer Tape while the Transfer Tape is extended laterally across a paper machine prior to a Turn-Up procedure.

Turn-Up: as used herein, a Turn-Up means a process involving switching a paper web from spooling on a nearly completed full web spool to spooling on an empty web spool. A Turn-up process may include severing a paper web from a rotating parent web roll nearing its capacity to hold paper, transferring the paper web to an empty web spool, and securing the paper web to the empty web spool.

Referring to FIG. 1 an exemplary embodiment of an Empty Web Spool 102 and Paperband Composite 107 is illustrated with the Paperband Composite 107 wound around a spool face 106 of the Empty Web Spool 102. A spool shaft 100 may be attached to Empty Web Spool 102 and will be generally concentric with a spool face 106 which acts as a surface onto which the paperband composite 107 may be mounted. Mounting of the Paperband Composite 107 may be accomplished via winding the Paperband Composite around the spool face 106 in a manner that maintains a specified margin 109 from each end 114 of the Spool Face 106.

Figure 1A:
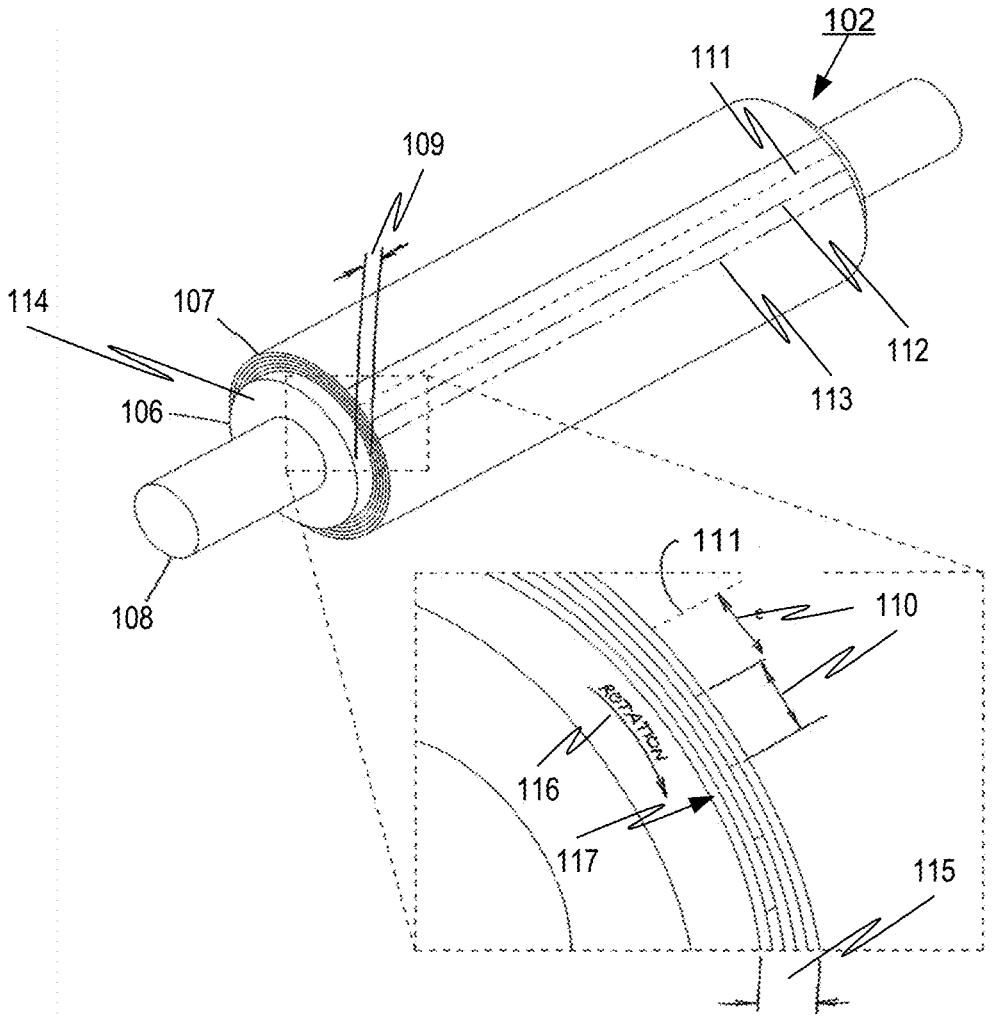
FIG. 1A illustrates an exemplary paperband composite and close up of a web spool applied in a manner generally aligned with the axis of the paper spool.

Referring now to FIG. 1A, the paperband composite 107 may be wrapped around a majority of a circumferences of the Empty Web Spool 102 where the length of the paperband composite 107 is generally perpendicular to the axis. In some examples, the paperband composite 107 may be preformed to have a width (illustrated in FIG. 3 as item 301) sized to be smaller than a width of the spool face 106, such that when applied there is a margin 109 on both ends of the Spool Face 106.

In FIG. 1A, an exemplary paperband composite 107 is illustrated with multiple layers 117 wrapped around the spool face 106 creating a multiple layer structure 115. The paperband composite 107 may include a substrate having a first side with applied adhesive (sometimes referred to as a spool mounting side). An adhesive on the first side may include a pressure sensitive adhesive (PSA) that is adapted to contact a spool face 106. The spool face 106 may include a longitudinal cylindrical surface of an empty web spool 102. A second side of the paperband composite (e.g., a web-side or web grabbing side), includes a second adhesive adapted to contact and adhere to a paper web 105 when a rotating empty web spool 102 is brought into contact with the paper web 105.

A relative location of lateral perforations 111-113 in the paperband composite 107 is illustrated in staggered positions relative to each other. The staggered positions may result in the change in circumference of each layer 117 included in the multiple layer structure 115 and the relation of a distance 110 between lateral perforations and the circumference of each layer. For example, the multiple layer structure 115 may include a first layer perforation 111, a second layer perforation 112, and a third layer perforation 113. In some embodiments of the present invention, the paperband composite 107 applied to the Empty Web Spool 102 may have a range of 360° layers 117 of Paperband Composite 107 wrapped around a circumference of the Spool Face 106. The range of layers 117 may include, for example, between about 2 and 10 layers 117 of Paperband Composite 107 wrapped around the circumference of the Empty Web Spool 102. In addition, a final layer 117 of Paperband Composite 107 wrapped around the circumference of the Empty Web Spool 102 may or may not include a full 360° of Paperband Composite 107 in relation to underlying layers 117.

Various embodiments include disparate locations of lateral perforations 111-113 along the length of the paperband composite 107. Empty Web Spools 102 may include multiple different standard circumferences of their respective Spool Faces 106. In some embodiments, a distance 110 between perforations 111-113 can be designed and/or selected based upon a corresponding circumference of a Spool Face 106 in use. Furthermore, as the paperband composite 107 is wrapped around the Spool Face 106, a diameter of wrapped Paperband Composite 107 and corresponding circumference of each respective layer 117 of Paperband Composite 107 increases (even if by only a small amount) with each layer. The change in circumference will change a relative alignment of perforations 111-113.

In the course of use of the wrapped paperband composite 107, the Empty Web Spool 102 may be rotating at very high speeds as it is matched to a rate of a Full Web Spool 101 from which it will divert paper web, in a turn-up operation. It may be desirable to ensure that the perforations 111-113 are staggered to avoid undermining the integrity of perforations located on one or more layers 117 below a layer 117 on the surface. For example, a score position of a second layer perforation 112 may be positioned so that it does not coincide with a score position of a layer 117 on the surface that includes a first layer perforation 111. In some examples, a distance 110 of stagger between perforations 111-113 of respective layers 117 may support integrity of the respective layer 117. An overlap of adhesive and substrate included in a Paperband Composite 107 may be used to prevent layers 117 of Paperband Composite 107 from loosening or dislodging when the Empty Web Spool 102 is spun up to a rotational speed that matches the rate of rotation of a surface of the surface layer 117 of the Paperband Composite 107 a rotational speed of a surface of a Paper Web 105 on a Full Web Spool 101.

In some embodiments, an operator and/or automation may apply a Paperband Composite 107 to an Empty Web Spool 102 I a direction of winding that allows an exposed edge of an outermost layer 117 to have a raised profile "downwind", that is pointing opposite a direction of rotation 116 to prevent aerodynamics from lifting the edge. Generally, this may imply rotating the Empty Web Spool 102 during application of the paperband composite 107 to the Empty Web Spool 102 in a same direction of rotation 116 that the Empty Web Spool 102 spins while taking up the paper web 105. In some other examples, a direction of winding may be in a direction that is opposite to a direction of rotation 116.

The paperband composite 107 is described in further detail in following sections, but generally it may include a substrate 203 which is coated on both sides with different adhesives and release formulations. The paperband composite 107 may be coated with a paper spool face adhesive 207 which an operator may apply to a clean Spool Face 106 to prepare the paper spool 401 for multiple turn-up and unspooling operations.

Figures 2, 2A:
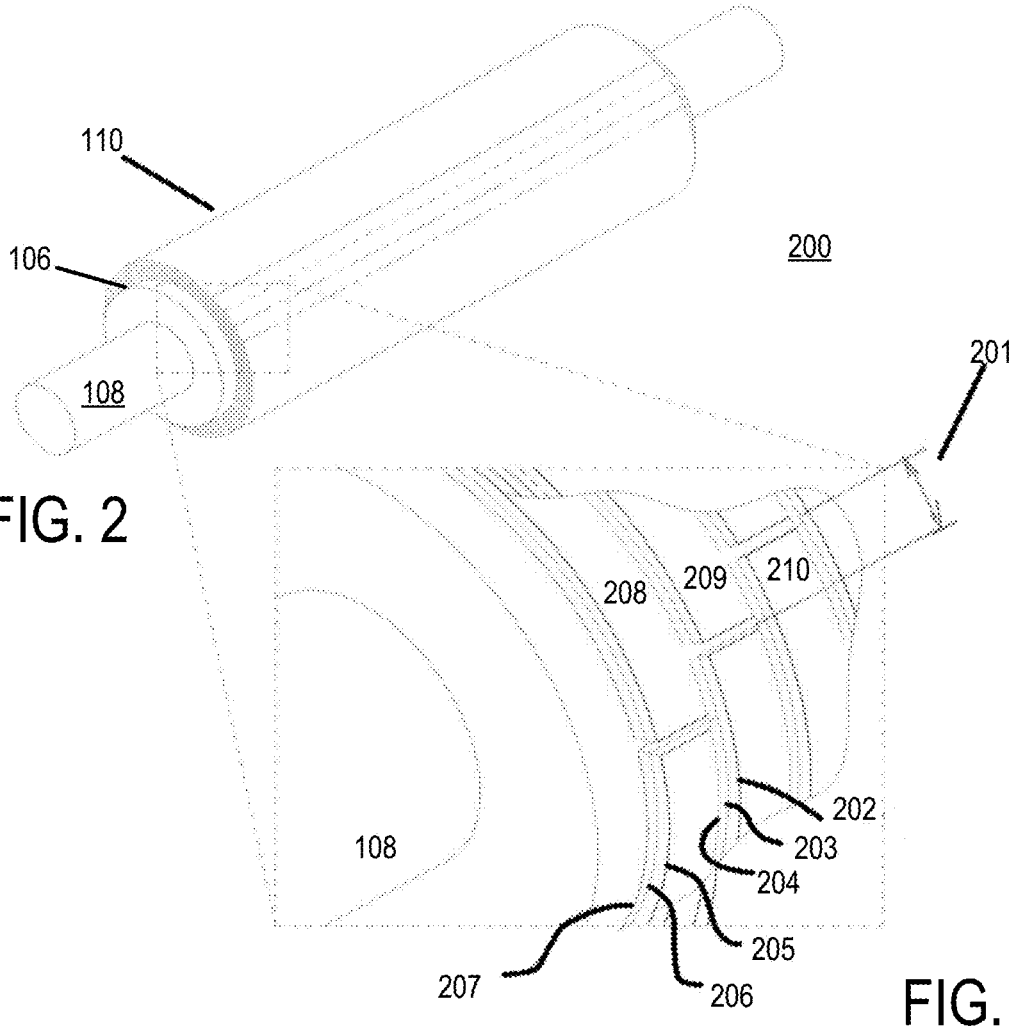
FIGS. 2-2A illustrate the exemplary paperband composite applied to a web spool applied in a manner generally aligned with the axis of the paper spool.

Referring now to FIG. 2, an exemplary example of a paperband composite 107 is included with different aspects highlighted in the inset FIG. 2A. The stagger 201 between perforations 111-113 is illustrated with additional features of the perforations 111-113 illustrated. There are various layers that are wrapped around the spool face 106 including a first layer 208 which may be in contact with, and in some embodiments adhesively attached to, the spool face 106. A second layer 209 overlaying the first layer 208. The first layer 208 may be backed with a spool face adhesive 207, that holds the paperband composite 107 in place. Subsequent layers 208-210 of the paperband composite 107 may be backed with one or more release coating 204 that allows any overlying layers (e.g.; 202-203), to be removed intact during an unspooling operation without delamination.

In some embodiments, a tissue adhesive coating 202 may be a topmost layer 208 of the paperband composite 107 wound on the spool face 106 and may be attached to a paper web 105 which is made to be rolled up upon the empty web spool 102 by spinning of the spool face 106 with the paper web 105 adhesively attached to the spool face via the paperband composite 107. Multiple subsequent adhesive attachments may be caused brought about by having multiple layers 208-210 of paperband composite 107 with a topmost layer 208 being removed after being attached to a paper web 105.

An attached tissue adhesive coating 202 may be placed upon a portion of the substrate 203 between two perforations 111-113. This portion of the paperband composite 107 may have a back portion of the substrate 203 coated with the release coating 204. When a wound paperweb 105 is unspooled and runs off until a full web spool 101 is returned to an empty web spool 102, an attached paperband composite 107 including a substrate 203 coated with adhesive coating 202 on one side and release coating 204 on the other side may also unspool as the release coating 204 releases from the underlying tissue adhesive coating 205.

A despooling process may apply an amount of force at the perforation 111-113 sufficient to cause a portion of the paperband composite 107 to separate along the perforation 111-113 and be removed from the empty web spool 102. The removal of the piece of paperband composite 107 up to a perforation 111-113 simultaneously exposes an underlying tissue adhesive coating 205 for future turn-up processing which may be caused by rotating the empty web spool 102 and contacting the underlying tissue adhesive coating 205 (which is now exposed as the top most layer 210) with a paper web 105. This tissue adhesive coating 205 is coated upon a top side of the substrate 203. In some embodiments, a single substrate 203 may be processed to form a paperband composite 107 with zones separated with processing to add perforations 111-113, adhesive (202, 205, 207) and release coatings 204.

In the illustrated inset FIG. 2, a tissue adhesive coating 205 is located on a last portion of a substrate 203. This portion of the substrate 203 may be coated on the reverse side of the substrate 203 with a paper spool face adhesive 207 instead of a release coating 204. Zone coating processes, such as spraying of silicones and adhesives on a substrate 203 of paper fiber, plastic film, or other flexible material, may be used to create the different zones upon the substrate 203.

In some embodiments of the present invention, zone processing of adhesives (202, 205, 207) and release coatings 204 may be performed after perforations 111-113 are formed in the substrate 203. In other embodiments zone processing of adhesives (202, 205, 207) and release coatings 204 may be processed before perforations 111-113 are formed in the substrate 203.

In some examples, the perforations 111-113 may be made via operation of a cutting die. The cutting die may remove portions of the substrate 203, creating small tabs that connect portions of the substrate 203 on either side of a perforation 111-113. In other examples, a perforation 111-113 may be formed by removal of substrate 203 material along a region.

In still further examples a combination of cutting and removal (which maybe abrasion removal) may be used to form the perforation 111-113. In still further examples, a perforation 111-113 may be formed by a joining of two separate substrate 203 pieces along respective edges where, for example, a thin tape material may join the substrate 203 pieces creating a perforation 111-113 structure that will rupture at a desired force induced by the unspooling process.

In some examples, the paperband composite 107 may be pre-formed into an assembly that an operator may use to prepare an empty web spool 102 for multiple turn-up operations. It may itself be spooled on a temporary spool or shaft that can be used by an operator to apply the paperband composite 107 to an empty web spool 102. In the examples of FIG. 1 and FIG. 2, the paperband composite 107 may be applied of an empty web spool 102 by wrapping the paperband composite 107 tangentially around the spool face 106 multiple times. (see for example FIGS. 3A-3B)

Figure 3:
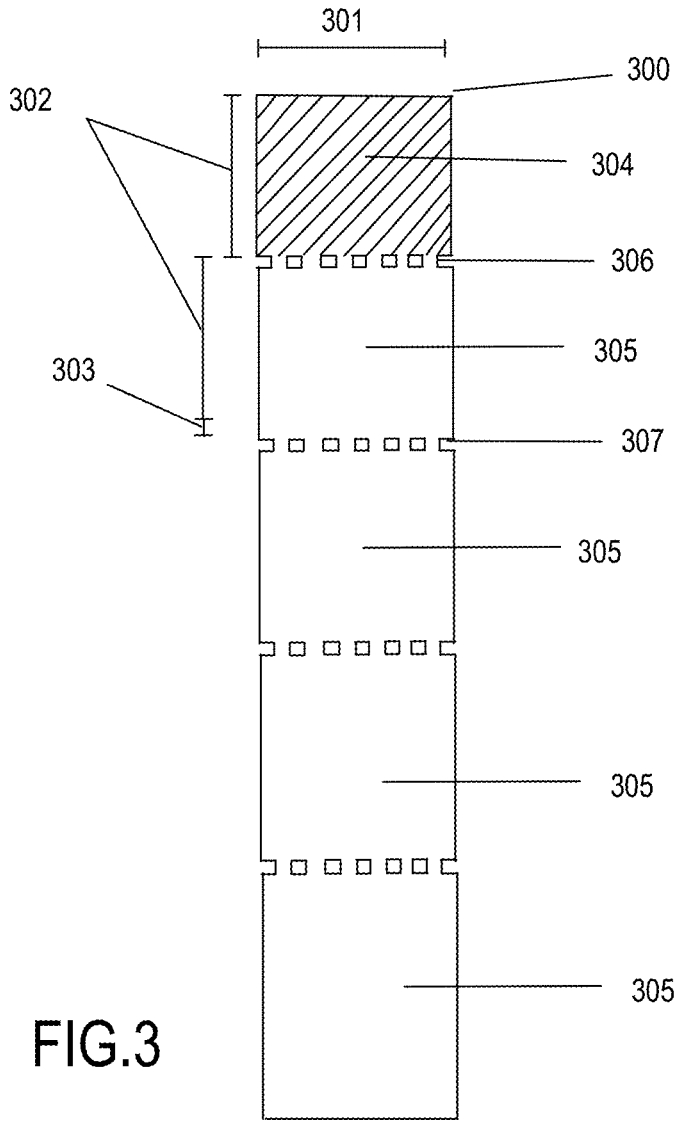
FIGS. 3, 3A, and 3B illustrate aspects of a paperband composite prepared for mounting on a spool face of an empty web spool.

Referring now to FIG. 3, an exemplary paperband composite 300 (similar to 107) may be formed with a substrate 203, such as a paper fiber band or a plastic film band cut to a width appropriate for the size of a Spool Face 106 with a designed margin region 109 on either side. (materials that may be used for the substrate of the paperband composite 300 or 107 may include, for example, a paper-based film or band(s), plastic films, or composites of paper and plastic films.)

In an example, perforations may be created along the length of the substrate 203 as is illustrated in perforations 306, 307. As described previously, there may be numerous different types of perforations 306, 307 employed. Spacing 302 between an edge and a first perforation and between perforations may vary with an exemplary extra length 303 illustrated. The difference in length may occur based upon a desired stagger 201 as well as the extra circumference that occurs as material is wrapped 308 around the Spool Face 106. Each of the regions between perforations 306 may comprise an adhesive layer for a single turn-up operation.

The side of the composite that faces the paper web after application may all be coated with an adhesive deposit to capture the paper during a transfer of the paper web. On the other side of the substrate 203 may be spool surface adhesive coated regions 304 for affixing the paperband composite 300 to the Spool Face 106. As mentioned, the adhesive strength of this deposit may be reduced compared to typical turn-up tapes because of the relatively large area of adherence in the composites of the present disclosure. The spool surface adhesive coated region 304 may occupy one end of the paperband composite 300. The other regions between perforations 306, 307 may be zones coated with release materials 305, such as in a non-limiting example a silicone coating.

Figure 3A:
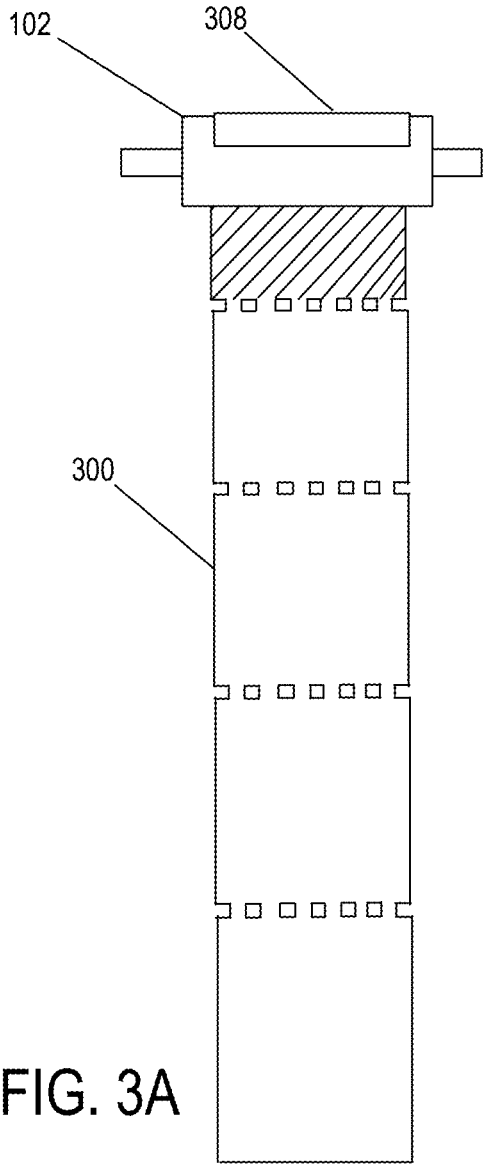

Referring to FIG. 3A, an exemplary application of a paperband composite 300 (similar to 107) to an empty web spool 102 is illustrated. A zone of the backside of the paperband composite 300 with spool adhesive applied may be aligned to the spool face 106 and as the empty web spool 102 is rotated this adhesive zone may be affixed to the Spool Face 106 and wrapped 308 around the empty web spool 102.

Figure 3B:
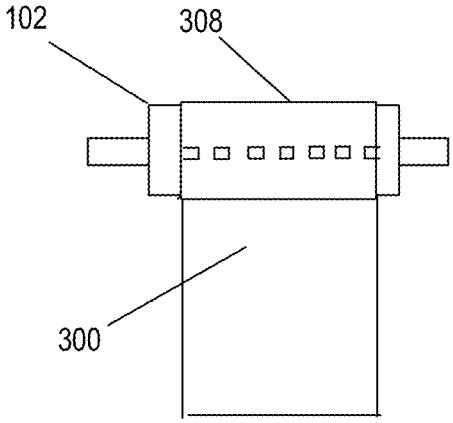

Proceeding to FIG. 3B, wrapping 308 may continue with the empty web spool 102 continuing to rotate while the paperband composite 300 adheres to the empty web spool 102. The paper adhesive layer of each level may weakly adhere to the release coated regions as the wrapping 308 continues. The characteristics of the release layer materials and deposition conditions as well as the adhesive strength of the paper adhesive may be engineered such that each wrapped 308 layer may grab a paper web and achieve turn-up during paper processing and then when the empty web spool 102 is unloaded at subsequent operations the end of the paper web may pull off the affixed paper adhesive coated portion and then rupture the perforation 306, 307 to the next level. The resulting empty web spool 102 may have additional coated layers to proceed to the next turn-up operation.

Finally, either after an empty web spool 102 is initially coated with a paperband composite 300 or 107 or after an unwinding process exposes a new surface layer of adhesive, these surface layers of adhesive may be protected for shipping or transport through the paper mill by a covering that is removed when the core is prepared for service.

In some embodiments, a multi-use paperband composite 107 may have a physical dimension with a length multiple times a circumference of an empty web spool 102 surface. During use of the empty web spool 102 with the applied paperband composite 107, the empty web spool 102 will have several "layers" of adhesive coated paperband composite 107 wound about it. A single layer of the paperband composite 107 will be used to adhere to a surface of a paper web 105 on a full web spool 101. A top layer of an adhesive layer included in the paperband composite 107 will become covered by multiple layers of paperweb 105 as the empty web spool 102 spins and coils up newly manufactured paperweb 105 to generate a full web spool 101.

An empty web spool 102 that may be filled with many layers of paperweb 105 to form a full web spool 101 and then may subsequently go through an unwinding process (sometimes referred to as "despooling" or "unspooling") in a processing facility. An unwound empty web spool 102 may then have a "used" layer of paper side adhesive on the substrate unwound exposing a fresh layer of adhesive coated substrate in the paperband composite 107. The empty web spool 102 may now be redeployed to receive a new volume of paperweb 105 and become a full web spool 101.

In another aspect, an empty web spool 102 that is devoid of paperband composite 107 (such as after multiple cycles of winding on tissue paper and unwinding the tissue paper), the empty web spool 102 may be cleaned. After cleaning, a new paperband composite 107 may be wrapped around the cleaned empty web spool 102.

Spiral Wrapped Paperband Composites

Figure 4:
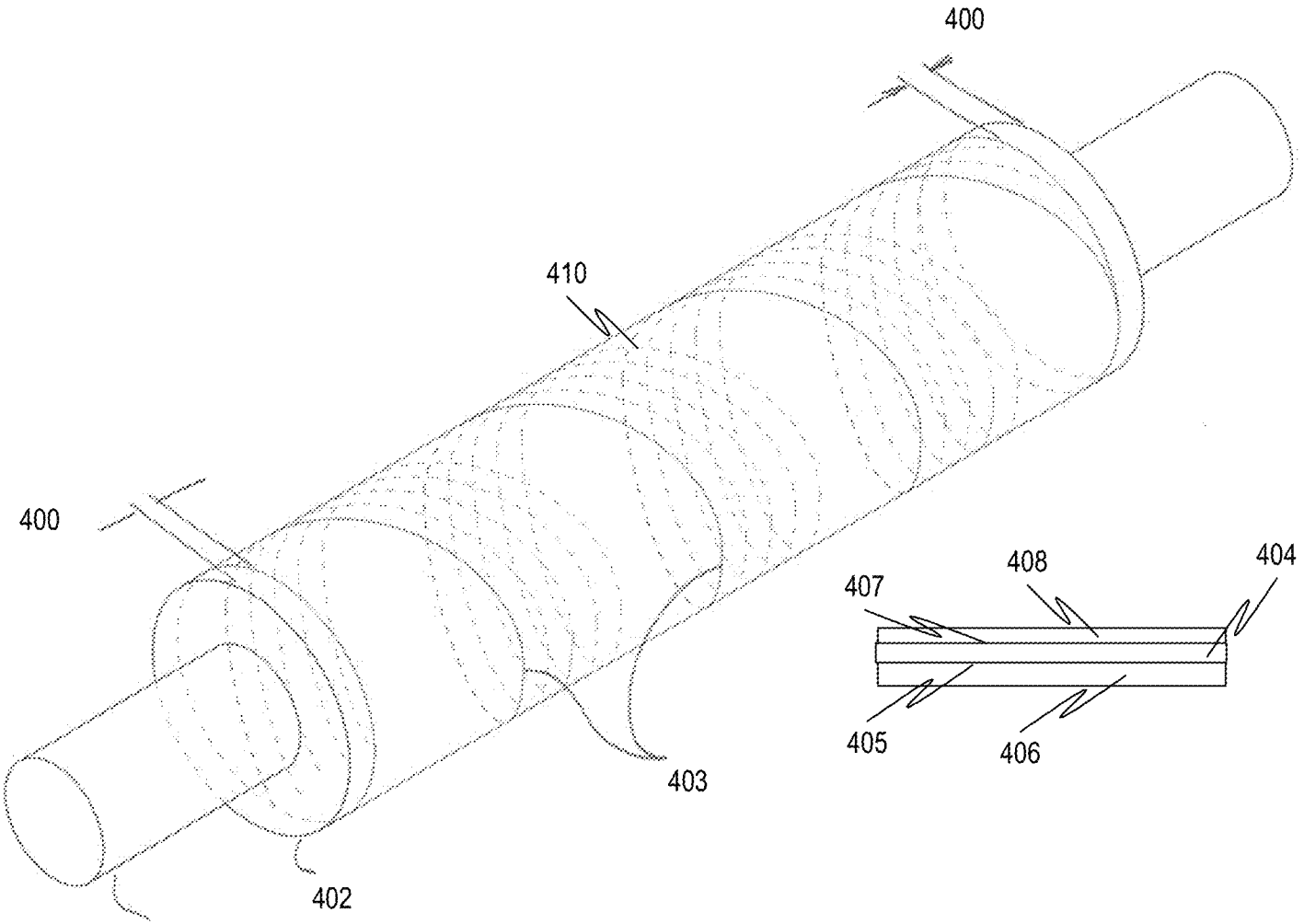
FIG. 4 illustrates an exemplary paperband composite applied to a web spool applied in a spiral manner around the spool face of an empty web spool.

Referring now to FIG. 4, in some embodiments, a paperband composite 404 or 107 may be applied to an empty web spool 102 at an angle relative to the direction of rotation 116 so that the paperband composite 107 winds onto the empty web spool 102 in a spiral fashion. A spirally wrapped paperband composite 404 may be applied at an angle to an axis of the empty paper spool 401 causing the paperband composite 404 to spirally wrap around the empty paper spool 401. Depending upon an initial angle of adherence, a spiral may overlap the edges of the composite, or it may be applied such that the edges essentially abut each other, or there may be a margin 400 between edges of adjacent spiral wraps 403.

In some embodiments, an operator or automation may create a spiral wrap of the paperband composite 404 in numerous steps. In a first step with a clean and empty paper spool 401, a paperband composite 404 formed of a substrate 203 with a paper spool face adhesive 207 on one side and a paper faced adhesive on another side may be wrapped at an angle to an axis of an empty paper spool 401 to create a first layer of paperband composite 404 arranged in a spiral wrap 403. In some embodiments, the paperband composite 404 may include aspects that allow for a consistent pattern of application. Aspects may include, by way of non-limiting example, a cutout at the beginning of the paperband composite 404 that allows a user to align the start of the attachment of the paperband composite 404 at a specific angle (see e.g.; item 601) if a cut edge of a paperband composite 404 is applied to a line on the spool face 402 that is parallel to the axis of the empty paper spool 401.

The empty paper spool 401 may continue to be wrapped with a same or different type of paperband composite 404. The paperband composite 404 may be formed of a substrate that is coated on a first side 405 with a release coating 407 and on a second side 406 with the paper grabbing attached tissue adhesive 408. Aligning the paperband composite 404 at an angle to an axis of rotation facilitates a consistent application of additional spiral wraps upon the spool face 402. The operator may adjust the starting point of each of the wraps so that the edges of the wrap do not overlap.

In the embodiments illustrated in FIG. 4, a paper spool 401 with a spool face 402, upon which multiple wraps of the paperband composite 404 have been applied in a spiral fashion. In some examples, a margin 400 may be maintained on either side of the spool face 402. The dotted lines 410 in the illustration, denote an overlap of multiple layers of the paperband composite 404 one upon another.

A benefit of spiral wrapping may be use of a relatively narrow paperband composite 404, such as, by way of non-limiting example, a paperband composite 404 with a width of 18-24 inches (107-400 mm.), to form wrapped layers. During an unwinding process, layers of paperband composite 404 with release coatings 407 on a backside of the paperband composite 404 may unwind at the end of the paper unwinding process, again exposing a new layer of attached tissue adhesive 408 for subsequent turn-up operations.

Figure 5:
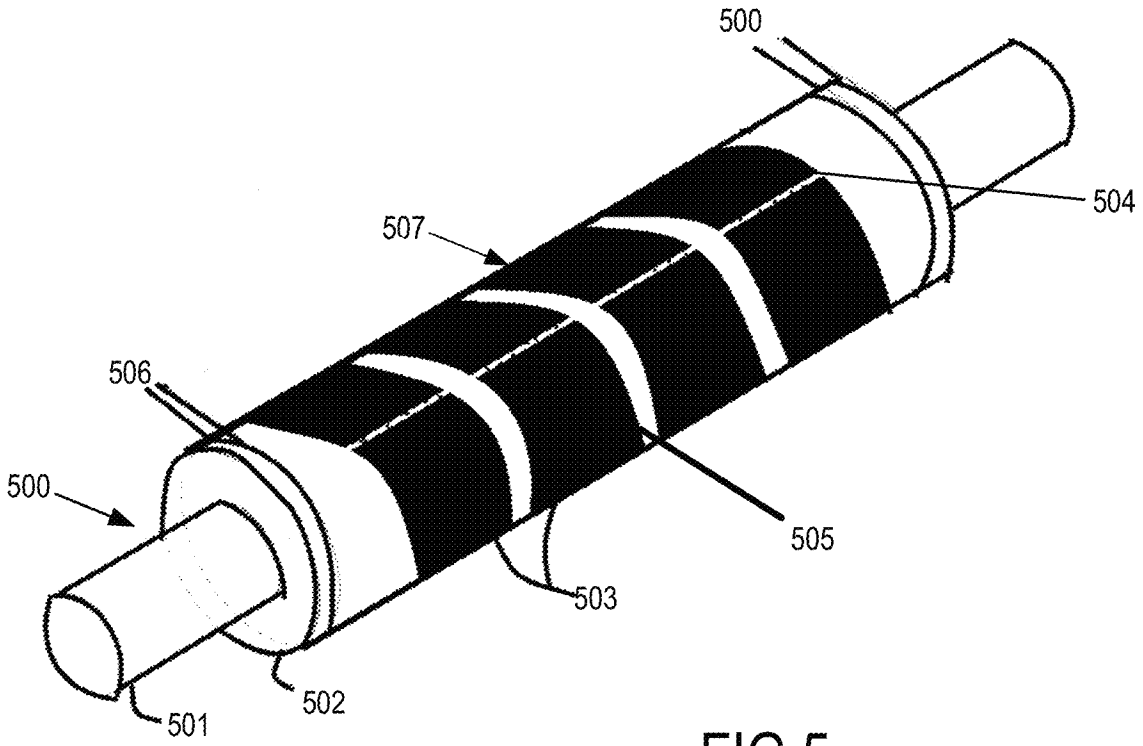
FIG. 5 illustrates another exemplary paperband composite applied to a spool face of an empty web spool in a spiral manner.

Referring now to FIG. 5, an exemplary spiral wrapping of paperband composite 507 is illustrated on an empty web spool 501. In some exemplary embodiments, a paperband composite 507 may be prepared for use that has been formed of multiple layers stacked upon each other. According to the present invention, a paperband composite 507 is applied to a spool face 502 in a manner such that a spiral wrap 503 may form a multiple use coating on a spool face 502. In some embodiments, a spiral wrap 503 may have overlap of spiral portions, in other embodiments, a space 505 may be present between spiral wraps 503. There may also be margins 506 left on either side of the spool surface 502.

In some embodiments, spirally wrapped layers of paperband composite 507 incorporate perforations 504 into the paperband composite 507 applied to the spool surface 502. In some examples, perforations 504 may be aligned at a same angle at which the paperband composite 507 is applied to the spool surface 502. When applied to the spool surface 502, the paperband composite 507 may be spirally spaced to line up disparate spirals along an axis of the paper spool 501. Therefore, when a layer of paperband composite 507 is unwound from the empty web spool 501 the paperband composite 507 may pull free of the spool surface 502 in a manner allowing the remaining paperband composite 507 to be positioned to receive paper web (not illustrated in FIG. 5).

Figure 6:
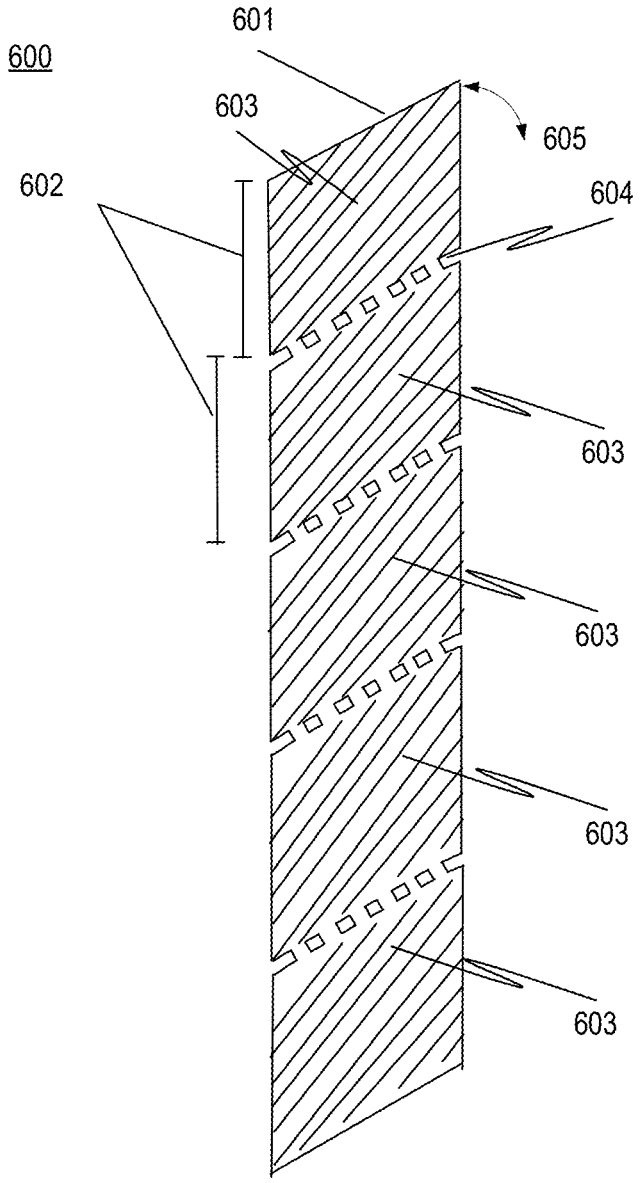
FIG. 6 illustrates aspect of the paperband composite prepared for mounting in a spiral manner around a spool face of an empty web spool.

Referring now to FIG. 6, an illustration of a multilayer paperband composite 600 for spiral wrapping is provided. The paperband composite 600 may have numerous features. An edge 601 of the paperband composite 600 may be cut at a specific angle 601. In some examples, a specific angle 601 of the paperband composite 600 may be aligned based upon a pre-cut edge to a longitudinal line on the spool face, and as the paperband composite 600 is then wound onto the paper spool it will assume a spiral shape along the spool face with a desired characteristic. Since the paperband composite 600 may be applied in a single spiral wrapping process, the spacing 603 between perforations 604 may be the same for all perforations 604 in the paperband composite 600. A single set of perforations 604 is illustrated for, such as those that may be formed as a bottom layer of a paperband composite 600 stack. In some embodiments, each layer of paperband composite 600 may have perforations 604 that are aligned at different positions in respective layers.

Perforations 604 may be formed at a specific angle 601 which may be parallel to an edge 601 of the paperband composite 600. As a paperband composite 600 is wrapped upon a spool surface (e.g.; item 502), perforations 604 in the paperband composite 600 may align with a direction of an axis of the spool surface. In some embodiments, spacing 603 between the perforations 604 may form a row of perforations 604. A bottom layer of paperband composite 600 may include a substrate coated on one side with a spool attaching adhesive. A spiral wrap of paperband composite 600 placed on a spool surface will interact with the spool surface and an adhesive may be chosen for a layer of paperband composite 600 that is closest to the spool surface. In addition, some or all of the portions of paperband composite 600 between perforations 604 in the paperband composite 600 may have an appropriate adhesive.

Figure 7:
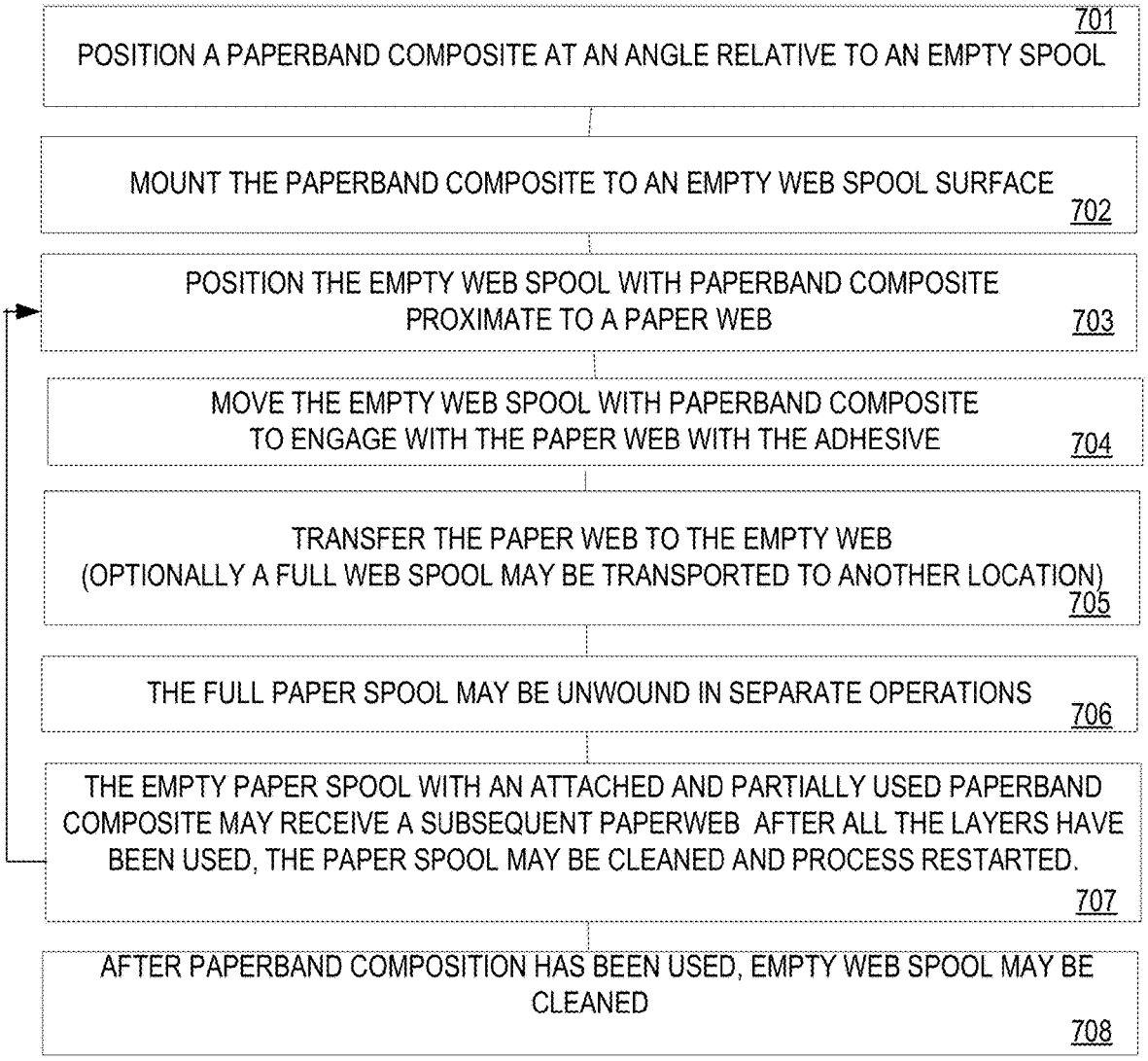
FIG. 7 illustrates exemplary method steps for utilizing a paperband composite.

Referring to FIG. 7 exemplary process steps for utilizing a paperband composite that may be performed according to the present disclosure is provided.

At step 701, a paperband composite suitable for severing and transferring paper web is positioned at an angle relative to an empty web spool. The paperband composite may include a substrate having a first side with applied adhesive, a spool mounting side, preferably including a pressure sensitive adhesive (PSA) that is adapted to contact a spool face surface, and adhere to a longitudinal cylindrical surface of the empty web spool. A second side of the paperband composite (e.g., a web-side or web grabbing side), may include a second adhesive adapted to contact and adhere to a paper web when a rotating empty web spool is brought into contact with the paper web.

A first adhesive of the first side of the paperband composite interacts with the spool face and may cause less damage to a fiber core or other spool surface by virtue of the fact that a weaker adhesive may be used in this application than in other paperband procedures. A weaker adhesive may be used because there is a significantly larger surface area that the paperband composite may adhere to as compared with other techniques. The weaker adhesive may be peeled off without delaminating the paper layers of the core or otherwise damaging a surface it is bound to.

Additional layers of a multi-use transfer adhesive sheet may include a release coated substrate and the second adhesive on a web side of the paperband composite. The paperband composite may adhere to the web side adhesive of the first layer applied, but it may be easily removed due to the release coating on the first side of subsequent substrate layers which may have less affinity for the web-side adhesive than the substrate face to which the web-side adhesive has been applied in manufacture of the paperband composite system.

In some examples of use, fiber or wound paper cores may be enhanced by the application of multiple layers of adhesive covering the entire surface of the core. The various examples of the paperband composite may be installed as sheets which are made by a continuous winding of the substrate and web-side adhesive. In some examples, the paperband composite may be scored transversely to create perforations. In other examples, the scoring of perforations may be orientated at a 30-45 degree angle. The repetitive space of the perforations may occur, and at intervals slightly longer than the circumference of the spool or the subsequent layers.

In some examples, as discussed in prior sections, the scoring that creates the perforations may be positioned on one adhesive layer in a different position from that of a previous layer in order that the higher layer may maintain the integrity of the previous layer preventing the layers of adhesive coated substrate from loosening or dislodging when an empty spool is spun up to match the surface speed of the paper web.

At step 702, the multi-use paperband composite is mounted onto a spool face of an Empty Web Spool.

At step 703, the Empty Web Spool is positioned with the paperband composite proximate to the paper web.

At step 704, the empty web spool with paperband composite is moved to engage with the paper web with the adhesive included in the paperband composite. For example, with a web-facing adhesive on the paperband composite wound around the empty web spool, the web-facing adhesive is exposed. The empty paper spool is positioned in a winding section of a paper machine and spun up to a rotational speed that is synchronized with a surface speed of the paper web spinning on the full web spool.

At step 705, when the adhesive layers match rotational speed of the paper web on a full paper spool the adhesive layer touches the paper web and causes the paper web to tear and follow the rotation of the adhesive layer, which causes the paper web to be wound around the empty web spool until the empty web spool becomes a full web spool.

The paper spool with attached adhesive layered paperband composite may be caused to contact the paper web by lowering the empty web spool into contact with the paper web (such as a tissue paper web) such that the tissue paper web may adhere to the adhesive on the paperband adhesive and be drawn around the empty paper spool. When it is drawn upon the empty paper spool the paper web may burst and separate from the full paper spool resulting in a turn-up. The full paper spool may optionally be transported to another location to be further processed.

At step 706, the full paper spool may be unwound in subsequent operations. At the end of the paper unwinding process (or runout), a layer of paperweb may remain adhered to an outer most layer of the turn-up paperband composite. This outer layer may be pulled off a lower layer of paperband composite at a release layer and adhesive interface. The resulting section may be torn away at the score to reveal a fresh adhesive surface that may be used in a subsequent turnup procedure without causing damage to the empty we spool face.

At step 707, the empty paper spool with an attached and partially used turn-up paperband composite may be returned to a paper processing operation to again receive paper web such as to step 703. In some historical examples, in cases where traditional turn-up tapes are used on paper spools, the spools may last fewer than 12 cycles before accumulating enough damage as to be unusable whereas the wound turn-up paperband composite can turn-up many times before attached paper spools are exhausted.

At step 708, after a number of such loops from step 703 to step 707 when the paperband composite has been fully used, any remaining portions of paperband composite on the spool may be removed with less likelihood of damage to the spool face. The lower rate of damage may be by virtue of a less-aggressive adhesive which may be used between the paperband composite and the spool face. If the spool face has not accumulated other damage and is still useful, the turn-up paperband composite may be replaced. Furthermore, reuse of a slightly damaged spool may be possible because the turn-up paperband composite may typically be laminated to the entire width and circumference of the core, covering and consolidating minor delamination, and other similar damage.

Referring now to FIG. 8A method steps are illustrated that may be completed in some implementations of the present invention. At step 802 a paperband composite may be wound onto a first spool face of the empty web spool, the paperband composite having a spool face adhesive and a paperweb adhesive. For example, device may wind a paperband composite onto a first spool face of the empty web spool, the paperband composite having a spool face adhesive and a paperweb adhesive, as described above.

As also shown in FIG. 8A, the method may include fixedly attaching the paperband composite to the first spool face spool face with the spool face adhesive (step 804). For example, device may fixedly attach the paperband composite to the first spool face spool face with the spool face adhesive, as described above. The method may include rotating the empty web spool and paperband composite at a rotational speed approximate to a rotational speed of a surface of a paperweb being wound on a first full web spool (step 806). For example, device may rotate the empty web spool and paperband composite at a rotational speed approximate to a rotational speed of a surface of a paperweb being wound on a first full web spool, as described above.

At step 808, the method may include contacting the paperweb with a first quantity of the first paperweb adhesive included in the paperband composite. For example, device may contact the paperweb with a first quantity of the first paperweb adhesive included in the paperband composite, as described above.

The method may also include adhesively binding a first portion of the paperweb to the empty web spool with the first quantity of the paperweb adhesive (step 810). For example, device may adhesively bind a first portion of the paperweb to the empty web spool with the first quantity of the paperweb adhesive, as described above.

The method may also include performing a turn-up process causing a first volume of paper web to spool on the empty web spool (step 812). For example, device may perform a turn-up process causing a first volume of paper web to spool on the empty web spool, as described above.

At step 816 the method may include spooling a first volume of paper web onto the empty web spool to form a second full web spool.

Figure 8B:
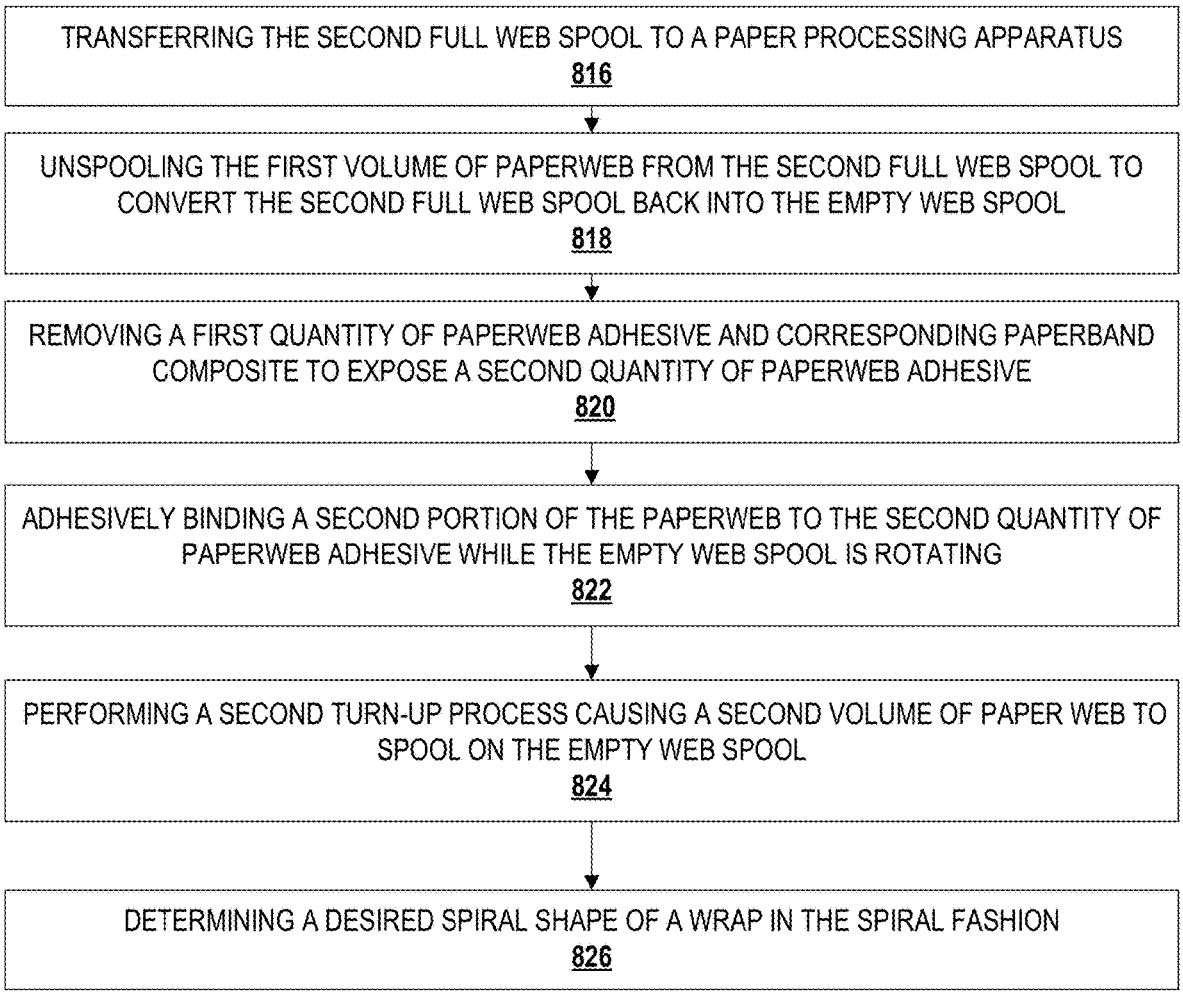

Referring now to FIG. 8B, at step 816 the method may include transferring the second full web spool to a paper processing apparatus, and at step 818 unspooling the first volume of paperweb from the second full web spool to convert the second full web spool back into the empty web spool.

At step 820 removing a first quantity of paperweb adhesive and corresponding paperband composite from the empty web spool to expose a second quantity of paperweb adhesive; and at step 822 adhesively binding a second portion of the paperweb to the second quantity of paperweb adhesive while the empty web spool is rotating.

At step 824 the method may include performing a second turn-up process causing a second volume of paper web to spool on the empty web spool.

In a various implementations, the step of removing the first quantity of paperweb adhesive and corresponding paperband composite from the empty web spool may include tearing the paperband composite along the plurality of perforations, and the step of removing the first quantity of paperweb adhesive and corresponding paperband composite may follow an unspooling of a first volume of paperweb from a second full web spool before the step of performing a second turn-up process.

The paperband composite may include a width equal to or less than a width of a spool face of the empty web spool and the paperband composite is wrapped approximately perpendicular to an axis of the empty web spool.

The paperband composite may be wrapped in a spiral fashion around the empty web spool. Also, the paperband composite may be formed with an angular cut out at an initial edge. The angular cut out may be aligned with an axis of the empty spool.

In some embodiments, a spool may be prepared by using one of the versions of the turn-up paperband composites related to spiral wrapping around the spool. In some examples, the paperband composite may be provided in rolls 12 to 18 inches (107-400 mm.) wide. The paperband composite roll, 12 to 18 inches (107-400 mm.) wide, which has a spool attaching adhesive layer may be attached to a spool face. In some optional examples, the paperband composite may be provided on a roll with an initial edge cut at an angle, such that the cut edge when lined up with a line on the spool face may ensure a wrap of the spool occurs with desirable aspects.

In some embodiments, a different roll of paperband composite material with release coatings on the backside may be used to spirally roll a second layer on the spool. A number of layers that have been applied may be compared to a desired target number and if less, processing may be repeated with fresh underlying layers until a number of layers reaches a target number of processing.

One general aspect includes a method of transferring a paper web from a full paper spool to an empty paper spool. The method includes obtaining a paperband composite, where the paperband composite may include a substrate, a first zone coated region of a spool face adhesive on a first side of the substrate, a second zone coated region of the first side of the substrate of a release coating, where the second zone coated region occupies at least a majority of a portion of the first side of the substrate not coated with the spool face adhesive, and a paper web grabbing adhesive coating on a second side of the substrate. The method may also include attaching the paperband composite to a first paper spool, where the first paper spool is empty of paper, and where the attaching is performed by applying the first zone coated region of the spool face adhesive to a spool face of the first paper spool; and engaging the first paper spool for a turn up transfer, where a paper web is transferred from a second spool, where the second spool is full of paper, to the first paper spool, where the paper web is adhered to the paper web grabbing adhesive coating of the paperband composite on the first paper spool.

Implementations may include one or more of the following features. The method may include: filling the first paper spool with a first amount of paper web; transferring the first paper spool to a paper processing apparatus, where the paper processing apparatus unspools the paper from the first paper spool; removing the portion of the paperband composite adhered to the paper web of the first amount of paper web; and engaging the first paper spool for at least a second turn up transfer with the paperband composite, where a paper web is transferred from a third spool to the first paper spool, where the third spool is full of paper, where the paper web is adhered to the paper web grabbing adhesive coating of the paperband composite on the first paper spool. The paperband composite further may include a plurality of perforations, where after the paperband composite is applied to the first paper spool each layer of the paperband composite may include a perforation. The removing of the portion of the paperband composite occurs while the first amount of the paper web is unspooled. The paperband composite may be wrapped in an approximately perpendicular manner to an axis of the first paper spool, where the paperband composite has a width substantially that of the spool face of the first paper spool. The paperband composite is wrapped in a spiral fashion. The paperband composite is formed with an angular cut out at its initial edge, where the angular cut out is aligned with an axis of the first paper spool to determine a desired spiral shape of a wrap in a spiral fashion.

One general aspect includes a paperband composite. The paperband composite may include a substrate, where the substrate is rectangular in shape; a first zone coated region of a spool face adhesive on a first side of the substrate; a second zone coated region of the first side of the substrate of a release coating, where the second zone coated region occupies at least a majority of a portion of the first side of the substrate not coated with the spool face adhesive; and a paper web grabbing adhesive coating on a second side of the substrate; and where a length of the paperband composite is sufficient to wrap the paperband composite around a paper spool multiple times.

Implementations may include one or more of the following features. The paperband composite may include multiple perforations, where the perforations are spaced such that when the paperband composite is wrapped upon the paper spool there is a perforation at each layer of wrapping. A spacing between perforations places the perforations in such a manner that they do not overlap when the paperband composite is wrapped upon the paper spool. The end is placed upon the paper spool to start an application of the paperband composite to the paper spool, and where the angular cut out aligns the paperband composite in a desired spiral pattern. The spool face adhesive has a tensile strength just sufficient to hold the paperband composite unto an area of the paper spool that it is attached to, where the tensile strength is small enough to minimize damage of the spool face when the paperband composite is removed. The paper web grabbing adhesive coating has a tensile strength sufficient to hold a paper web as it is grabbed during a turn-up operation and of a characteristic such that an interaction of the web grabbing adhesive with the release coating allows the wrapped paperband composite to remain adhered on a paper spool as a perforation tears during an unspooling process.

One general aspect includes a method of preparing a turn-up paperband composite. The method also includes cutting a substrate layer to a designed width and length, where a width target is calculated as the width of a spool face reduced by a margin distance for each end, and where the length is calculated based on a number of desired wraps around the paper spool multiplied by a circumference of the paper spool; applying a spool face adhesive to a first side of the substrate layer, where the length of an applied spool face adhesive application is based on the circumference of the paper spool; applying a release formulation to at least a portion of an uncoated part of the first side of the substrate; and applying a web grabbing adhesive formulation to a second side of the substrate.

Implementations may include one or more of the following features. The method of preparing a turn-up paperband composite may include cutting the substrate layer at an edge at an angle to an adjacent side edge, where the angle creates a new edge of the turn-up paperband composite that may be applied to the paper spool.

One general aspect includes a method of preparing a turn-up paperband composite. The method may include cutting a substrate layer to a designed width and length, where a width target is calculated as the a fraction of the width of a spool face reduced by a margin distance for each end, where the fraction is based on a number of spiral wraps designed to be placed on the paper spool, and where the length is calculated based on a number of desired wraps around the paper spool multiplied by a circumference of the paper spool multiplied by the number of spiral wraps; applying a spool face adhesive to a first side of the substrate, where the length of an applied spool face adhesive application is based on the circumference of the paper spool; applying a release formulation to at least a portion of an uncoated part of the first side of the substrate; and applying a web grabbing adhesive formulation to a second side of the substrate Implementations may include one or more of the following features. The method of preparing a turn-up paperband composite may include: cutting the substrate layer at an edge at an angle to an adjacent side edge, where the angle creates a new edge of the paperband composite that may be applied to the paper spool. A direction of the perforation cuts is aligned to the angle of the new edge of the paperband composite; and where a location of the perforations is such that the perforation of each spiral wrap aligns with its neighboring spiral wrap.

One general aspect includes a method of preparing a turn-up paperband composite. The method may include cutting a plurality of substrate layer pieces, where each piece is cut to a designed width and length, where a width target is calculated as the a fraction of the width of a spool face 502 reduced by a margin distance for each end, where the fraction is based on a number of spiral wraps designed to be placed on the paper spool, and where the length is calculated based on a circumference of the paper spool multiplied by the number of spiral wraps; applying a spool face adhesive to a first side of a first substrate layer piece; applying a web grabbing adhesive formulation to a second side of the first substrate layer piece; placing the first substrate layer piece upon a release coated covering substrate; applying a release formulation to a first side of each of the remaining substrate layer pieces; applying a web grabbing adhesive formulation to a second side of each of the remaining substrate layer pieces; stacking each of the substrate layer pieces upon the first substrate layer piece, such that the turn-up paperband composite is formed as a stack of substrate layer pieces each having a web grabbing adhesive facing up and a release layer facing down; and where, when applied, the turn-up paperband composite forms a spool face capable of performing multiple turn-up operations.

Implementations may include one or more of the following features. The method of preparing a turn-up paperband composite may include wrapping a processed turn-up paperband composite on an application spool, where a user unwraps the turn-up paperband composite from the application spool as it is applied to a paper spool.

What is claimed is:

1. A paperband composite for transferring a paper web from a full web spool to an empty web spool, the paperband composite comprising:

a substrate having a first side and a second side;

wherein the first side comprises a spool surface adhesive coated region and a plurality of release coated regions extending from the spool surface adhesive coated region;

wherein the second side comprises a paper web adhesive coating; and wherein the paperband composite further comprises a plurality of perforations at predetermined locations along a length of the substrate, wherein the plurality of perforations are spaced to create a staggered alignment when wrapped around the empty web spool.

2. The paperband composite of claim 1, wherein the spool surface adhesive coated region comprises a pressure-sensitive adhesive (PSA) adapted to contact a spool face of the empty web spool.

3. The paperband composite of claim 2, wherein the substrate has a width that is less than the width of the spool face of the empty web spool, creating a margin on either side of the spool face when applied.

4. The paperband composite of claim 1, wherein the paper web adhesive coating on the second side of the substrate is a high-tack adhesive which facilitates adherence to a moving paper web.

5. The paperband composite of claim 1, wherein the plurality of release coated regions on the first side of the substrate comprise a silicone-based release coating.

6. The paperband composite of claim 5, wherein the substrate is coated with a spool surface adhesive and the silicone-based release coating using a zone coating process.

7. The paperband composite of claim 1, wherein the substrate is made of a flexible material selected from the group consisting of paper, plastic film, and a composite of paper and plastic film.

8. The paperband composite of claim 1, wherein the paperband composite is wrapped in a spiral fashion around the empty web spool.

9. The paperband composite of claim 1, wherein the paperband composite includes an angular cut-out at an initial edge to aid in alignment with an axis of the empty web spool.

10. The paperband composite of claim 1, wherein the paper web adhesive coating on the second side of the substrate has a tensile strength, which facilitates separation of the paper web being spooled on the full web spool.

11. The paperband composite of claim 1, wherein the plurality of perforations are formed by a cutting die that creates small tabs connecting portions of the substrate on either side of the plurality of perforations.

12. The paperband composite of claim 1, wherein the paper web adhesive coating is applied to the second side of the substrate using a spray coating process.

13. The paperband composite of claim 1, wherein the paperband composite is pre-formed into an assembly that can be spooled onto a temporary spool for application to the empty web spool.

14. The paperband composite of claim 1, wherein the paperband composite is applied to the empty web spool tangentially along a spool face and perpendicular to an axis of rotation of the empty web spool.

15. The paperband composite of claim 14, wherein the paperband composite is designed to be used for multiple turn-up operations without causing damage to the spool face.

16. The paperband composite of claim 1, wherein the paperband composite is applied to the empty web spool in multiple layers, each layer providing an outwardly facing adhesive for attaching the paper web and an inwardly facing adhesive for attaching to the empty web spool.

17. The paperband composite of claim 1, wherein the paperband composite includes a protective covering that can be removed prior to use to protect adhesive layers during shipping and handling.

18. The paperband composite of claim 1, wherein the paperband composite is designed to be applied to an empty web spool that has been cleaned to remove any previous adhesive residues.

19. The paperband composite of claim 1, wherein the paperband composite is designed to be used with a paper machine that operates at speeds exceeding 6000 feet per minute.

20. The paperband composite of claim 1, wherein the paperband composite is designed to be used with a paper web having a width of over 400 inches.

* * * * *